US005335560A

United States Patent [19]

Wang

[11] Patent Number: 5,335,560

[45] Date of Patent: Aug. 9, 1994

[54] TABLE-TOP GRINDER POWER TRANSMISSION MECHANISM

[76] Inventor: Tian-Wang Wang, No.45, Yi Chang E. Rd., Tai Ping Hsiang, Taichung Hsien, Taiwan

[21] Appl. No.: 8,349

[22] Filed: Jan. 22, 1993

[51] Int. Cl.[5] ..... F16H 21/22; B24B 7/08

[52] U.S. Cl. ..... 74/22 R; 51/34 H

[58] Field of Search ..... 74/22 R; 51/34 H

[56] References Cited

U.S. PATENT DOCUMENTS

| | | | |
|---|---|---|---|
| 1,277,377 | 9/1918 | Carter | 51/34 H |
| 1,762,606 | 6/1930 | Bjorklund | 74/22 R |
| 1,881,839 | 10/1932 | Monson | 51/34 H |
| 2,244,813 | 6/1941 | Tommerup | 74/22 R |
| 2,519,542 | 8/1950 | Carey et al. | 74/22 X |
| 3,418,758 | 12/1968 | McEwan | 51/34 H |

FOREIGN PATENT DOCUMENTS

| | | | |
|---|---|---|---|
| 327525 | 9/1919 | Fed. Rep. of Germany | 51/34 H |

*Primary Examiner*—Allan D. Herrmann

*Attorney, Agent, or Firm*—Bacon & Thomas

[57] ABSTRACT

Disclosed is a table-top grinder power transmission mechanism for driving a grinding wheel to polish the surface of a workpiece, which includes a spindle driven by a motor to turn the grinding wheel, and a reciprocating mechanism to reciprocate the spindle during the operation of the motor. The reciprocating mechanism includes a worm wheel meshed with a worm on the output shaft of the motor, a bearing block coupled to the spindle by a bearing and connected to an eccentric location on the worm wheel by a link.

1 Claim, 2 Drawing Sheets

TABLE-TOP GRINDER POWER TRANSMISSION MECHANISM

BACKGROUND OF THE INVENTION

The present invention relates to a table-top grinder power transmission mechanism which reciprocates a grinding wheel as it is turned to polish the surface of a workpiece.

In making things out of wood, each workpiece should be polished so as to provide a smooth and shiny surface. Various table-top grinders have been proposed for this purpose, and have appeared on the market. A normal table-top grinder generally comprises a grinding wheel driven by a motor to polish the surface of a workpiece. As the grinding wheel is fixed in place and driven to turn on its central axis, wooden chips may be adhered to the grinding surface of the grinding wheel as the grinding wheel is being turned to polish the surface of a wooden workpiece. If there is any wooden chips adhered to the grinding surface of the grinding wheel, the surface of the wooden workpiece being polished may be scraped and damaged.

SUMMARY OF THE INVENTION

An object of the present invention is to eliminate the aforesaid problem. Another object of the present invention is to provide a table-top grinder power transmission mechanism which reciprocates a grinding wheel as it is turned to polish the surface of a workpiece. Still another object of the present invention is to provide a table-top grinder power transmission mechanism which utilizes a motor to turn a grinding wheel, and a reciprocating mechanism driven by the motor to reciprocate the grinding wheel. According to the preferred embodiment of the present invention, the reciprocating mechanism comprises a worm coupled to the output shaft of the motor, a worm wheel meshed with the worm, a bearing block connected to an eccentric location on the worm wheel by a link, a spindle coupled to the output shaft of the motor and the bearing block. The spindle is turned by the output shaft of the motor and simultaneously reciprocated by the link through the bearing block as the motor was started. A bearing is mounted between the bearing block and the spindle so that the spindle can be turned by the output shaft of the motor and reciprocated by the bearing block at the same time without causing a conflict.

DETAILED DESCRIPTION OF THE PREFERRED EMBODIMENT

Figure 1:
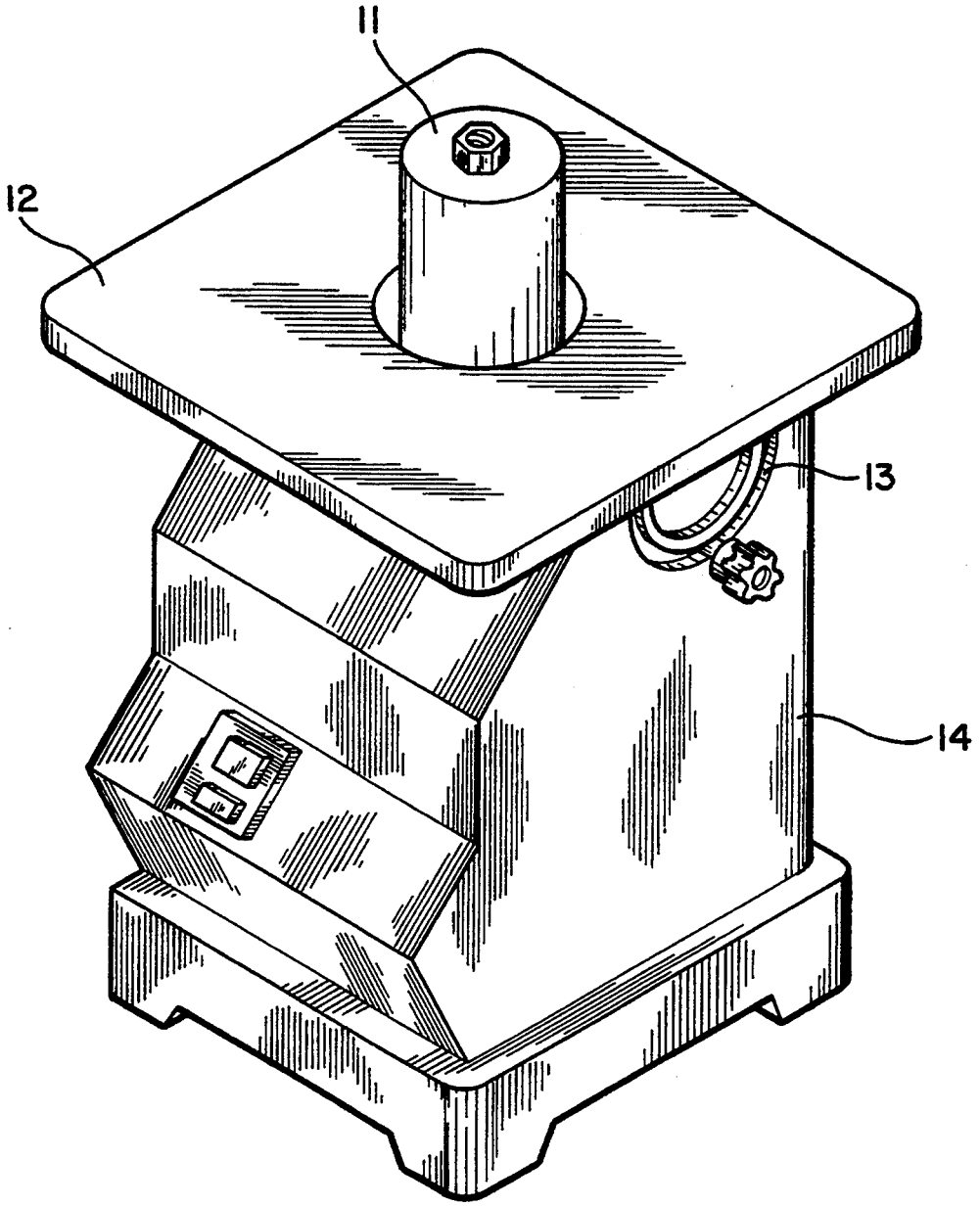
FIG. 1 is an elevational view of a table-top grinder embodying the present invention.
Figure 2:
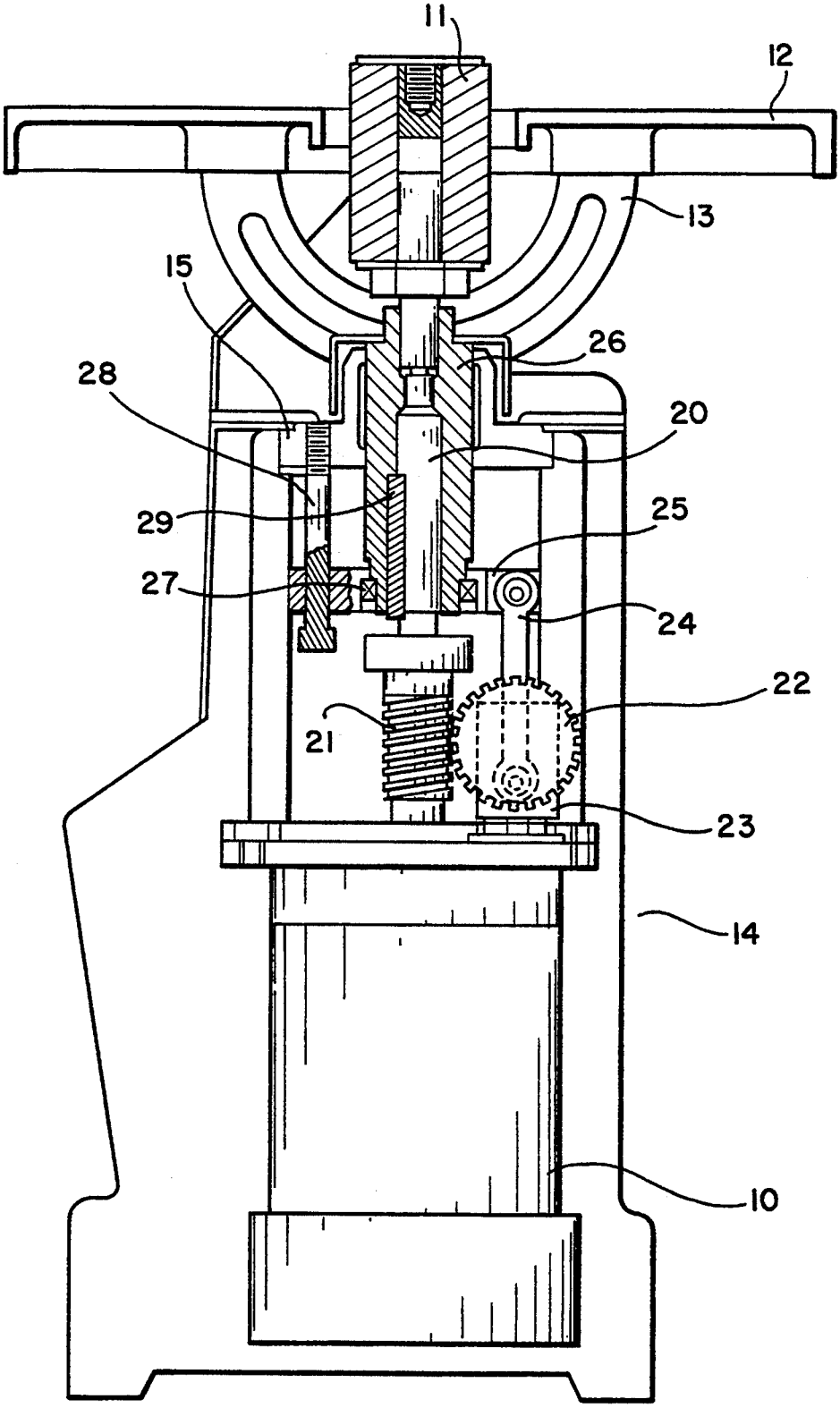
FIG. 2 is a sectional side view thereof showing the arrangement of its transmission mechanism.

Referring to FIGS. 1 and 2, a table-top grinder in accordance with the present invention is generally comprised of a motor 10, a grinding wheel 11, a work table 12, a protractor scale 13, and a housing 14. A worm 21 is coupled to the output shaft 20 of the motor 10 and meshed with a worm wheel 22. The worm wheel 22 is carried on a worm wheel holder 23 fastened to the housing 14 on the inside. A bearing block 25 is connected to the worm wheel 22 by a link 24. The link 24 has one end coupled to the bearing block 25 and an opposite end connected to the worm wheel 22 at an eccentric location. The grinding wheel 11 is coupled to the output shaft 20 of the motor 10 by a spindle 26 and key 29. Therefore, turning on the motor 10 causes rotary motion of the spindle 26 and the worm 21. Rotating the worm 21 causes the worm wheel 23 to drive the link 24 in reciprocating the bearing block 25. As the bearing block 25 is reciprocated by the worm wheel 22 through the link 24, the grinding wheel 11 is turned by the output shaft 20 of the motor 10 through the spindle 26. A bearing 27 is mounted between the bearing block 25 and the spindle 26. Therefore, the rotation of the spindle 26 does not cause the bearing block 25 to rotate; the reciprocating movement of the bearing block 25 does not interfere with the rotary motion of the spindle 26. Further, there are two guide bolts 28 inserted through holes (not shown) on the bearing block 25 and fastened to a top wall 15 of the housing 14 for guiding the reciprocating movement of the bearing block 25.

Referring to FIG. 2 again, turning on the motor 10 causes the spindle 26 to turn the grinding wheel 11. At the same time, the worm wheel 22 is driven by the worm 21 to reciprocate the link 24, thereby causing the bearing block 25 to reciprocate the spindle 26 and the grinding wheel 11. Therefore, the grinding wheel 11 moves up and down along the workpiece as the workpiece is being polished.

I claim:

1. A table-top grinder power transmission mechanism including a motor for driving a grinding wheel to polish the surface of a workpiece, the transmission mechanism comprising: a worm coupled to a rotatable output shaft of the motor so as to rotate therewith; a worm wheel meshed with said worm such that rotation of the worm causes rotation of the worm wheel; a spindle coupled between said grinding wheel and said output shaft of said motor such that rotation of the output shaft causes the grinding wheel to rotate; a bearing block non-rotatably mounted on said spindle by a bearing; a link having one end connected to said bearing block and an opposite end attached to said worm wheel at an eccentric location such that rotation of the worm wheel causes reciprocation of the link; and a plurality of fixed guide bolts inserted through said bearing block so as to guide the movement of the bearing block, whereby said motor causes said output shaft to turn said grinding wheel via said spindle, and simultaneously causes said link to reciprocate said grinding wheel via said bearing block and said spindle.

* * * * *